United States Patent [19]

Allard

[11] Patent Number: 4,626,298

[45] Date of Patent: Dec. 2, 1986

[54] METHOD OF MAKING FLAT MULTIPLE CONDUCTOR CABLE

[75] Inventor: Ira L. Allard, Rancho Palos Verdes, Calif.

[73] Assignee: TRW Inc., Redondo Beach, Calif.

[21] Appl. No.: 715,697

[22] Filed: Mar. 25, 1985

[51] Int. Cl.[4] ..... H01B 13/06

[52] U.S. Cl. ..... 156/55; 156/306.6; 156/322; 156/330.9; 174/117 F; 428/179; 428/473.5; 428/521

[58] Field of Search ..... 156/52, 55, 56, 322, 156/306.6, 330.9; 174/117 F, 117 FF; 428/473.5, 521, 179

[56] References Cited

U.S. PATENT DOCUMENTS

| | | | |
|---|---|---|---|
| 3,082,292 | 3/1963 | Gore | 156/55 X |
| 3,547,718 | 12/1970 | Gordon | 156/55 |
| 3,833,755 | 9/1974 | Soelberg | 156/55 X |
| 3,900,662 | 8/1975 | Yuan | 428/473.5 X |
| 3,932,689 | 1/1976 | Watanabe et al. | 428/418 |
| 4,090,902 | 5/1978 | Ferrentino et al. | 156/322 X |
| 4,098,628 | 7/1978 | Walton | 156/52 |
| 4,375,379 | 3/1983 | Luetzow | 174/117 F X |

*Primary Examiner*—Robert A. Dawson
*Attorney, Agent, or Firm*—Noel F. Heal

[57] ABSTRACT

A lightweight pliable flat conductor cable comprises a plurality of round wire conductors supported within generally parallel channels defined cooperatively by preformed and bonded plies of a polyimide insulation sheet material, particularly such as Kapton film. The Kapton film is highly resistant to degradation from exposure to ultraviolet radiation and further provides the conductor cable with a high degree of pliability throughout a broad range of temperature extremes, as encountered, for example, in an outer space environment. A method of forming the flat conductor cable is also disclosed.

10 Claims, 11 Drawing Figures

METHOD OF MAKING FLAT MULTIPLE CONDUCTOR CABLE

BACKGROUND OF THE INVENTION

This invention relates generally to an electrical conductor cable having multiple conductor wires for carrying a plurality of different electrical signals. More particularly, this invention relates to an improved lightweight and pliable flat conductor cable designed for long-term use substantially without degradation or failure due to exposure to ultraviolet radiation or temperature extremes.

Electrical conductor cables, sometimes referred as wiring harnesses, typically include a plurality of elongated conductor elements for carrying a plurality of electrical signals, for example, between components of electronic equipment as in a computer system or the like. The conductor elements commonly comprise elongated wires of a conductive material, such as copper or the like, having a generally round cross-sectional shape and individually jacketed by an appropriate insulation material. The plurality of insulated wires are assembled into generally parallel relation and collectively retained within an outer wrap of insulation material to form the conductor cable. In accordance with one common cable geometry, the conductor wires are bundle together to form a cable having a generally round cross-sectional shape with sufficient flexibility and compactness for use in a wide range of applications. However, in some cable installation applications, particularly such as a spacecraft environment, substantially increased cable flexibility and reduced cable thickness can be highly desirable to accommodate volumetric size constraints. In such applications, the conductor wires are assembled into a generally coplanar or flat cable configuration. Moreover, in a spacecraft environment, the insulation material encasing the conductor wires preferably comprises a specialized material which will maintain the desired level of flexibility and dielectric properties during use in outer space.

In the past, one dielectric material found to be especially suited for use in an outer space environment without significant degradation comprises a polyimide sheet material manufactured and sold by E. I. du Pont de Nemours and Company, Wilmington, Delaware, under the trademark Kapton. More specifically, Kapton polyimide sheet material is a lightweight and highly pliable substance possessing excellent dielectric properties and adequate tensile strength for use as an insulation material for electrical conductor elements. Moreover, Kapton sheet material is highly resistant to physical degradation in an outer space environment including, for example, resistance to embrittlement from exposure to ultraviolet radiation or from outgassing in a vacuum and resistance to degradation from exposure to temperature extremes within a range typically encountered in outer space. However, Kapton sheet material resists conventional thermal forming and shaping processes and thus heretofore has not been formed into a configuration satisfactory for use as a flat cable insulation material.

More particularly, flat conductor cables have been constructed to include a plurality of round wire conductors insulated individually by spirally wrapped strips of Kapton sheet material, with the thus-wrapped conductors being retained in a flat cable configuration within an outer jacket typically of a molded polyester plastic or the like. However, the outer jacket is subject to degradation in an outer space environment thereby providing significant potential for cable failure over a period of time. Moreover, the use of spirally wrapped Kapton strips particularly in addition to the outer jacket of a different material undesirably and unacceptably increases the overall thickness and stiffness of the flat conductor cable.

Alternative flat conductor cables have been developed using Kapton sheet material for insulating thin ribbon-like conductor elements in lieu of conventional round wire conductors, as described above. In such alternative cables, a plurality of the ribbon-like conductor elements are retained in spaced, generally parallel relation between two plies of Kapton sheet material bonded together with an appropriate adhesive. While such cables possess a substantially minimum thickness and further have exhibited a high degree of longevity in outer space use, each of the plurality of thin conductor elements must have a substantial width to provide the necessary current-carrying capacity. As a result, the overall width of the flat conductor cable becomes unduly large and unacceptable for many installation applications.

There exists, therefore, a significant need for an improved flat conductor cable of the type having a plurality of round wire conductors, wherein the round wire conductors are encased by formed plies of Kapton sheet material for optimum flexibility, compactness, and longevity in an outer space environment. The present invention fulfills these needs an provides further related advantages.

SUMMARY OF THE INVENTION

In accordance with the invention, an improved flat conductor cable includes a plurality of round wire conductors encased within generally parallel formed channels defined cooperatively by bonded upper and lower plies of polyimide insulation sheet material, particularly such as Kapton film. At least one of the Kapton film plies is preformed preferably by a thermal forming process to include a generally parallel plurality of spaced, open-topped channels for individually receiving the round wire conductors. The other Kapton film ply is then bonded by a suitable adhesive onto the preformed ply to close the open-topped channels and form the lightweight pliable flat conductor cable.

In a preferred form of the invention, and in accordance with a preferred process for forming the invention, a lower ply of Kapton film is placed over the face of a forming die having a plurality of elongated, generally parallel grooves therein. A plurality of elongated die bars of heat conductive material are inserted one at a time into adjacent forming die grooves to press and seat the lower Kapton film ply into conformance with said grooves. An upper platen is placed over the forming dies to form a closed die assembly retaining the die bars within the grooves while the lower Kapton film ply is subjected to a thermal forming step at about 850° F. to about 900° F. for about 30 minutes, resulting in thermal forming of said lower ply to include a plurality of open-topped and spaced parallel channels.

The upper platen and the die bars are then removed to expose the lower Kapton film ply and the channels formed therein. Round wire conductors, such as flexible braided copper wire or the like, are seated individually within the open-topped channels while the lower ply remains seated upon the forming die. An adhesive substance, prefereably in the form of a thin sheet of a thermal setting nitrile adhesive or the like is placed over the lower Kapton film ply and the seated conductors, followed by placement of the upper Kapton film ply and the upper platen. The thus-reassembled die assembly is subjected to a thermal bonding step, for example, by exposure to a temperature of about 350° F. for about 5 minutes while maintaining the upper and lower Kapton film plies in intimate contact with the adhesive sheet. The resultant flat conductor cable is then stripped from the die assembly ready for use or for appropriate connection to an additional conductor cable segment to form a cable of increased length.

Other features and advantages of the present invention will become more apparent from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
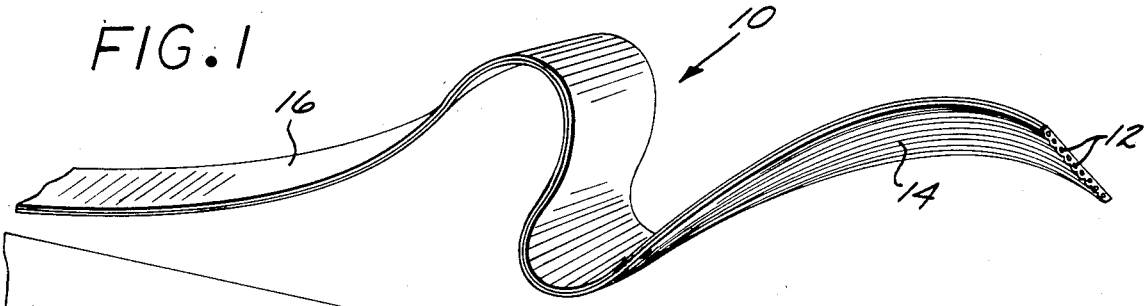
FIG. 1 is a fragmented perspective view illustrating a flat conductor cable embodying the novel features of the invention.
Figure 2:
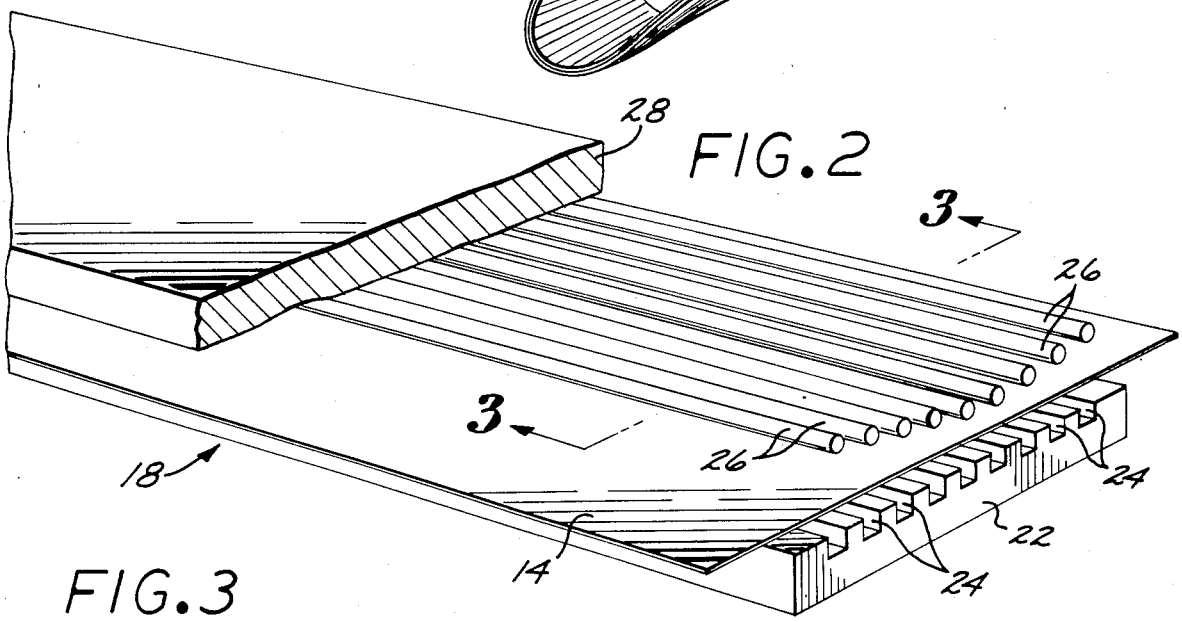
FIG. 2 is an enlarged fragmented exploded perspective view illustrating a die assembly for preforming a lower Kapton film ply for use in the conductor cable of the invention.
Figure 3:
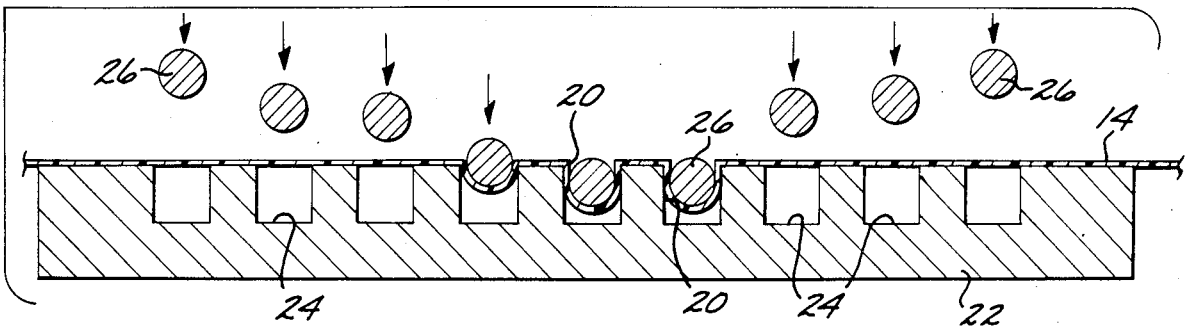
FIG. 3 is an enlarged transverse vertical sectional view taken generally along the line 3—3 of FIG. 2 and illustrating seating of the lower Kapton film ply into grooves in the face of a forming die comprising a portion of the die assembly.

As shown in the accompanying drawings, an improved conductor cable referred to generally by the reference numeral 10 has an elongated and generally flat configuration supporting in parallel array a plurality of generally coplanar round wire conductors 12. These round wire conductors 12 are supported within preformed channels between a lower ply 14 and an upper ply 16 of a polyimide insulation sheet material selected for resistance to degradation upon exposure to ultraviolet radiation and temperature extremes as encountered, for example, in an outer space environment.

The improved flat conduct cable 10 of the present invention advantageously provides a relatively thin and thus compact cable geometry for interconnecting components of electronic equipment, for example, as in a computer system or the like, with substantially minimum volumetric space requirements. The round wire conductors 12 are supported in spaced, electrically insulated relation by the lower and upper plies 14 and 16, which, according to the apparatus and process of the invention, are advantageously formed from polyimide film or sheet material manufactured and sold by E. I. du Pont de Nemours and Company, Wilmington, Delaware, under the name Kapton. This Kapton film material is lightweight and possesses highly desirable pliability characteristics with excellent dielectric properties. In addition, Kapton film is highly resistant to degradation, such as embrittlement, when subjected to an outer space environment including relatively high exposure to ultraviolet radiation, exposure to temperature extremes, and prolonged exposure to vacuum.

The flat conductor cable 10 of the present invention and a preferred process for the manufacture thereof are shown in more detail in FIGS. 2–8. More particularly, with specific reference to FIGS. 2–4, the lower ply 14 of the Kapton film material is initially preformed within a die assembly 18 to include a longitudinally elongated plurality of spaced parallel channels 20 of open-topped configuration for subsequent reception of the round wire conductors 12, as will be described. This lower Kapton film ply is provided in lightweight sheet form having a thickness within the range of about 0.5 mil to about 5.0 mil, with a preferred sheet thickness being on the order of about 1.0 mil. The lower ply 14 is placed over an elongated forming die 22 having an upwardly presented face shaped to define a longitudinally elongated plurality of upwardly open grooves 24 shown in the illustrative drawings to have a generally rectangular cross-sectional shape.

The lower Kapton film ply 14 is pressed or otherwise drawn into conformance with the upper face of the forming die 22 whereby said lower ply 14 is preformed to include the elongated open-topped channels 20. In the preferred process, such conformance is achieved by placing elongated die bars 26 individually into the forming die grooves 24 to press the lower ply 14 into intimate seated relation within and following the contour of the grooves 24. As shown best in FIG. 3, these die bars 26 are inserted one at a time in a regular or serial fashion by placing a subsequent die bar into a forming die groove 24 adjacent an alreadyinserted die bar to prevent significant stretching of the Kapton film material which could otherwise cause undesired film tearing. Accordingly, the die bars can be inserted into adjacent grooves beginning at the transverse center of the forming die and then proceeding outwardly on opposite sides thereof, as viewed in FIG. 3, or the die bars can be placed into the grooves beginning at one side of the forming die. In either case, the lower Kapton film ply 14 has sufficient transverse width to span the width of the forming die 22 when pressed by the die bars 26 into conformance with the forming die grooves 24.

Figure 4:
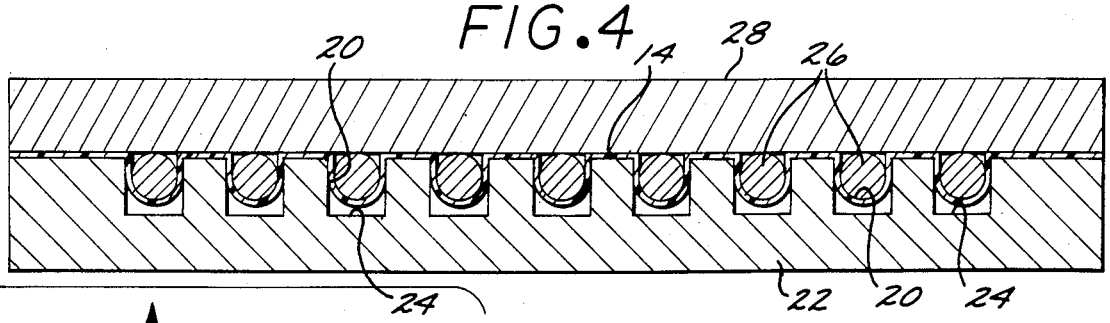
FIG. 4 is a transverse vertical sectional view generally similar to FIG. 3 but illustrating the die assembly in a closed state during a thermal forming step.

When the die bars 26 are inserted, an upper platen 28 forming a portion of the die assembly 18 is placed over the lower ply 14 and the inserted die bars 26, as viewed in FIG. 4. In accordance with the preferred process of the invention, die assembly 18 is then subjected to a thermal forming step by appropriate exposure to an elevated temperature causing the lower ply to assume a thermal set in conformance with the geometry of the forming die face. In this regard, it has been found that the Kapton film ply having a thickness within the range of about 0.5 mil to about 5.0 mil will assume the desired thermal set whn exposed to elevated temperature in the range of about 825° F. to about 950° F., and preferably within the range of about 850° F. to about 900° F., for at least about 30 minutes, with only light pressure maintaining the die assembly in a closed state being required. Exposure of a temperature above this range tends to cause undesired crystalization of the Kapton film, whereas exposure to a temperature below about 850° F. fails to produce the desired thermal set. Moreover, the thermal forming step is enhanced by constructing the die assembly 18 including the die bars 26 from a material having high thermal conductivity, such as aluminum, and further by shaping the die bars 26 for generally mating reception into the forming die grooves 24 to insure intimate heat transfer contact with the lower film ply 14.

Figure 5:
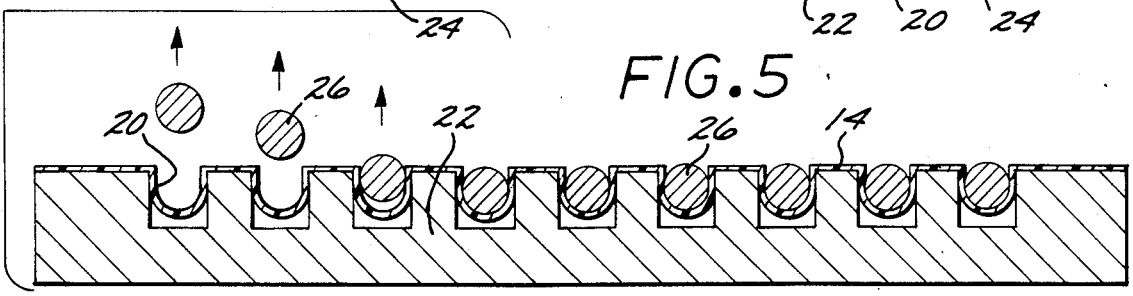
FIG. 5 is a transverse vertical sectional view similar to FIG. 3 but illustrating removal of die bars from the forming die grooves subsequent to the thermal forming step.
Figure 6:
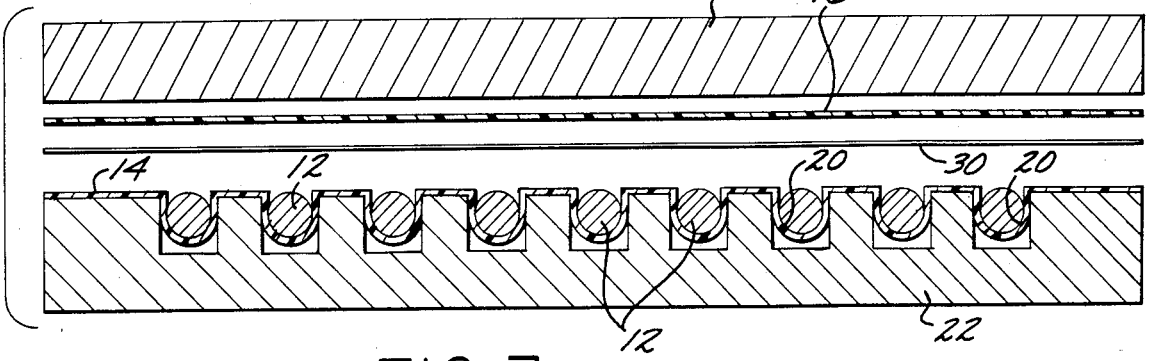
FIG. 6 is a transverse vertical sectional view similar to FIG. 3 but illustrating reassembly of the die assembly in association with round wire conductors and an upper Kapton film ply.

Subsequent to the thermal forming step, the upper platen 28 is removed to expose the preformed lower Kapton film ply 14 and the plurality of die bars 26, thereby permitting removal of the die bars as shown in FIG. 5. The preformed channels 20 in the lower ply 14 are thus exposed to permit individual placement of the round wire conductors 20 into those channels, as shown in FIG. 6. Conveniently, these round wire conductors 12 are formed from a relatively soft braided wire of a material such as copper or aluminum wire having a high degree of flexibility and a diametric size generally corresponding with the depth of the channels 20.

Figure 7:
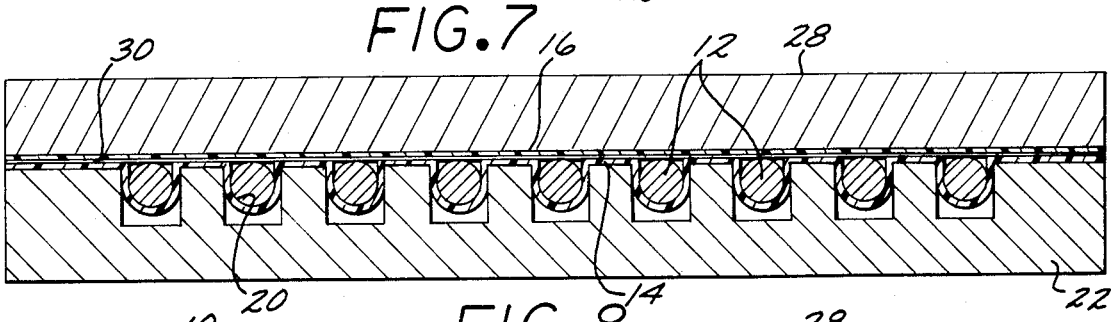
FIG. 7 is a transverse vertical sectional view generally similar to FIG. 6 but illustrating the die assembly in a closed state during a thermal bonding step.

An adhesive substance is then placed over the lower Kapton film ply 14 and the conductors 12 seated within the preformed channels 20. Although the specific type and form of adhesive substance may vary as understood by those skilled in the art, one preferred adhesive substance comprises a relatively thin sheet of a thermal setting nitrile adhesive 30 having a size and shape generally corresponding with the length and width of the forming die 22. The upper Kapton film ply 16, which also has a length and width generally corresponding to the forming die 22, is then placed over the nitrile adhesive sheet 30 followed by reassembly of the upper platen 28 with the forming die 22 with sufficient pressure to maintain the lower and upper plies 14 and 16 in intimate contact with the adhesive sheet 30. The thus-reassembled die assembly 18, as viewed in FIG. 7, is ready for a thermal bonding step including a temperature sufficient to bond the plies 14 and 16 together via the adhesive sheet 30. In this regard, when a sheet of nitrile adhesive material is used, a thermal forming step comprising exposure of the die assembly 18 to a temperature of about 350° F. for a time period of about 5 minutes is sufficient to provide a highly satisfactory thermal bond.

Figure 8:
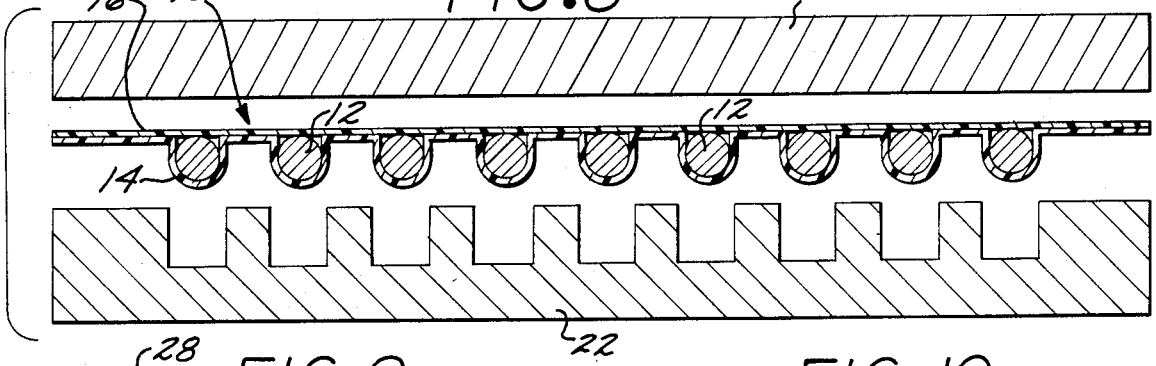
FIG. 8 is an exploded transverse sectional view generally similar to FIG. 6 but illustrating removal of the flat conductor cable from the die assembly.

As shown in FIG. 8, following the thermal bonding step, the thus-formed flat conductor cable 10 having the round wire conductors 12 encased therein can then be stripped from the die assembly 18 by appropriate removal from the upper plate 28 and the lower forming die 22. The resultant conductor cable 10 cooperatively supports and insulates the conductors 12 separately within the channels 20 to permit independent transmission of electrical signals via said conductors. The Kapton film plies 14 and 16 are lightweight and possess a high degree of flexibility of pliability for versatile use in a wide variety of conductor cable environments. The improved conductor cable 10 is particularly suited to use in an outer space environment, since the Kapton film material is highly resistant to degradation from exposure to ultraviolet light or prolonged exposure to a vacuum. Moreover, the Kapton film material maintains its desired high pliability without embrittlement or ply separation throughout a wide range of temperature extremes typically encountered within an outer space environment.

The overall length of the improved conductor cable 10 manufactured in accordance with the process depicted in FIGS. 2–8 is not limited to the longitudinal length of the forming die 22, nor is it necessary to physically splice adjacent ends of the round wire conductors 12 to provide a cable of increased overall length. Instead, as shown in FIGS. 9–11, the Kapton film plies encasing the conductors 12 can be installed in segments with misaligned, overlapping ends in association with continuous or uninterrupted conductors 12 to provide a conductor cable of virtually any desired overall length.

Figure 9:
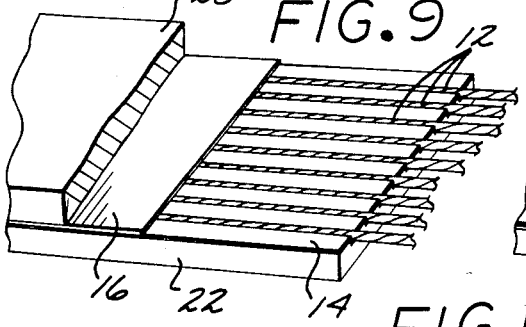
FIG. 9 is a fragmented perspective view illustrating formation of a flat conductor cable segment designed for connection with an adjacent cable segment to form a conductor cable of increased length.

More particularly, as depicted by way of example in FIG. 9, round wire conductors 12 can be seated as described previously within preformed channels 20 of a lower Kapton film ply 14, wherein the round wire conductors 12 project substantially beyond the underlying aligned ends of the lower ply 14 and the forming die 22. The preformed lower ply 14 and the seated conductors 12 can then be covered by a suitable adhesive substance and an overlying upper Kapton film ply 16, followed by placement of the upper platen 28, generally as described above, but with the upper ply 16 and upper platen 28 terminating in longitudinal misalignment relative to the lower ply 14. A thermal bonding step as previously described can then be performed to provide a conductor cable segment with longitudinally misaligned lower and upper plies 14 and 16.

Figure 10:
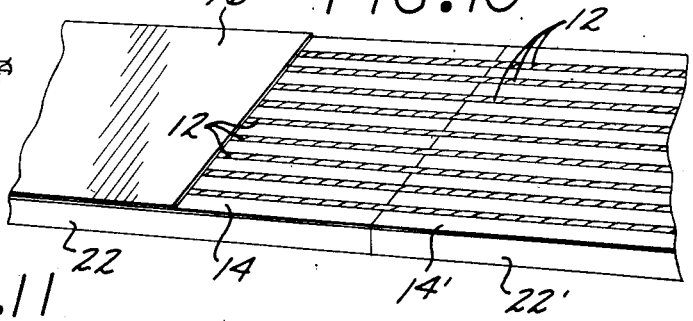
FIG. 10 is a fragmented perspective view similar to FIG. 9 and illustrating a subsequent step in the connection of conductor cable segments.
Figure 11:
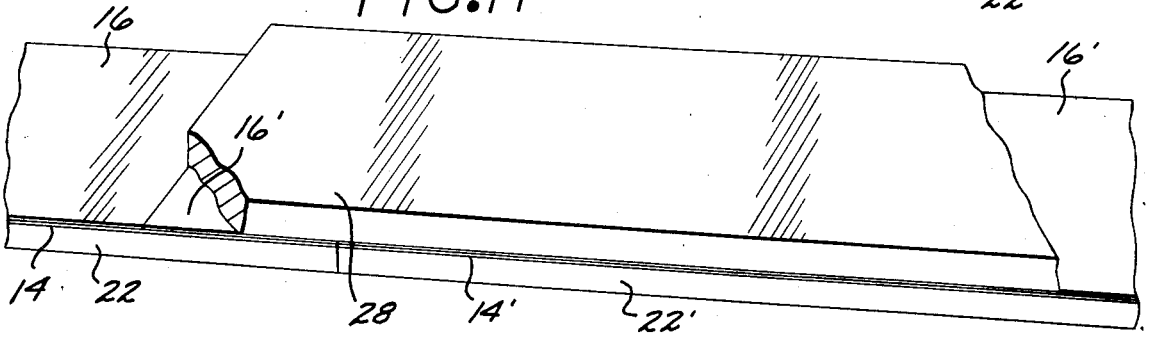
FIG. 11 is a fragmented perspective view illustrating a further step in the connection of conductor cable segments.

The thus-formed cable segment is then positioned in end-to-end relation with an adjacent lower Kapton film ply 14' having preformed channels 20' and carried by an adjacent identical forming die 22 to permit seating of the conductors 12 within the aligned channels 20', as shown in FIG. 10. A second upper ply 16' and associated adhesive substance are then placed in overlying relation with the exposed portions of the lower plies 14 and 14', as viewed in FIG. 11, and this second upper ply 16' is covered by the upper platen 28 for performance of a subsequent thermal bonding step. An elongated conductor cable is thus formed having lower Kapton film plies 14 and 14' and upper film plies 16 and 16' disposed respectively in end-to-end relation but with the upper and lower ply ends longitudinally misaligned relative to each other. The conductor cable segments are thus interconnected in a secure and stable manner while permitting use of continuous round wire conductors 12 thereby permitting manufacture of a conductor cable of any desired length.

A variety of modifications and improvements to the conductor cable 10 and manufacturing method of the present invention as described above will be apparent to those skilled in the art. Accordingly, no limitation on the invention is intended by way of the description herein, except as set forth in the appended claims.

What is claimed is:

1. A method of forming a flat conductor cable having a plurality of elongated generally round wire conductors, comprising the steps of:

preforming a plurality of elongated and generally parallel spaced channels into a lower ply of a relatively thin and lightweight polyimide sheet material;

placing the round wire conductors into the spaced channels of the lower ply of polyimide sheet material; and bonding the lower ply of polyimide sheet material together with an upper ply of a relatively thin and lightweight polyimide sheet material with the round wire conductors supported within the spaced channels.

2. The method of claim 1 wherein said preforming step comprises a thermal forming step.

3. The method of claim 2 wherein said thermal forming step comprises exposing the polyimide sheet material to a temerature within the range of from about 825° F. to about 950° F. for about thirty minutes.

4. The method of claim 3 wherein said thermal forming step comprises exposing the polyimide sheet material to a temperature within the range of from about 850° F. to about 900° F.

5. The method of claim 1 wherein said bonding step comprises supporting the upper and lower plies in intimate contact with an adhesive substance therebetween.

6. The method of claim 5 wherein the adhesive substance comprises a thermal setting adhesive and said bonding step further includes exposing the adhesive to a setting temperature sufficient to bond the upper and lower plies together.

7. The method of claim 6 wherein the adhesive substance is a sheet of a nitrile adhesive, said temperature exposing step comprising exposing the nitrile adhesive sheet to a temperature of about 350° F. for about five minutes.

8. A method of forming a flat conductor cable having a plurality of round wire conductors, comprising the steps of:

preforming a lower ply of polyimide sheet material to include a plurality of elongated, open-topped, and generally parallel spaced channels;

placing the round wire conductors into the channels;

overlying the lower ply with an adhesive substance;

placing an upper ply of polyimide sheet material in overlying relation with the adhesive substance and the lower ply; and bonding the upper and lower plies together.

9. The method of claim 8 wherein said preforming step comprises a thermal forming step, and wherein said bonding step comprises a thermal bonding step.

10. A method of forming a flat conductor cable having a plurality of round wire conductors, comprising the steps of:

placing a lower ply of polyimide sheet material having a thickness within the range of about 0.5 mil to about 5.0 mil over a forming die having a plurality of elongated generally parallel spaced grooves formed therein;

displacing and retaining the lower ply into conformance with the grooves in the forming die by inserting an elongated die bar into one of the grooves and then inserting subsequent die bars one at a time respectively into subsequent grooves each adjacent a groove having a die bar already inserted therein;

covering the die bars and lower ply with an upper platen and exposing the lower ply to a temperature of about 825° F. to about 950° F. for a time of about thirty minutes for thermally forming the lower ply to include a plurality of longitudinal open-topped channels;

removing the upper platen and the die bars from the lower ply;

placing a thermal setting adhesive over the lower ply;

placing an upper ply of polyimide film sheet material having a thickness within the range of about 0.5 mil to about 5.0 mil over the thermal adhesive;

covering the upper ply with the upper platen and subjecting the thermal setting adhesive to a temperature of about 350° F. for about five minutes to bond the upper and lower plies together thereby forming the conductor cable; and removing the thus-formed conductor cable from the upper platen and the forming die.

* * * * *